United States Patent [19]

Hicks

[11] 4,303,154

[45] Dec. 1, 1981

[54] ADJUSTABLE CONTAINER FOR CIGARETTE PACKAGES

[76] Inventor: Harlan D. Hicks, 520 E. Hamlin, West Salem, Wis. 54669

[21] Appl. No.: 225,733

[22] Filed: Jan. 16, 1981

[51] Int. Cl.[3] ..... A24F 15/00; B65D 85/10

[52] U.S. Cl. ..... 206/86; 206/242; 206/248; 206/236; 220/8

[58] Field of Search ..... 206/248, 242, 249, 254, 206/261, 276, 86, 216; 220/8

[56] References Cited

U.S. PATENT DOCUMENTS 2,302,784 11/1942 Lytton et al. ..... 206/248

2,306,613 12/1942 Chesley ..... 206/248

3,968,874 7/1976 Corey ..... 206/248

*Primary Examiner*—Joseph Man-Fu Moy

*Attorney, Agent, or Firm*—Williamson, Bains, Moore & Hansen

[57] ABSTRACT

A cigarette case is provided with adjustable features to accommodate cigarette packages of varying lengths and widths. A longitudinally slidable insert serves to accommodate variations in package length while a swingable side panel attached to the insert is biased inwardly to accommodate variations in width of the package. A hinged package lid engages the lid of a hard-pack cigarette package for simultaneous opening therewith.

12 Claims, 9 Drawing Figures

ADJUSTABLE CONTAINER FOR CIGARETTE PACKAGES

BACKGROUND OF THE INVENTION

The instant invention is in the field of cigarette cases for containing cigarette packs. Heretofore, a number of attempts have been made at providing a cigarette case capable of accommodating a number of different sized cigarette packages. These efforts include U.S. Pat. Nos. 3,589,505; 3,081,867; 2,306,613; 1,280,165; 2,303,426; 3,395,787; and 3,454,151. While these patents are capable of accommodating differing length packages, none of the aforementioned devices is designed to accommodate differing width packages such as those present in many brands presently being marketed. Thus, it is an object of the instant invention to provide a cigarette case capable of accommodating different sized packages.

SUMMARY OF THE INVENTION

The instant invention comprises generally a tubular sleeve having a lid at the top end thereof, which lid has a small lip on the underside of the front wall for engaging the front edge of a flip-top carton. This allows both lids to be opened simultaneously. Located inside the sleeve is a slidable insert having a rear wall having a tongue thereon which is slidably located in a groove in the rear wall of the sleeve. This construction allows the insert to be slid up and down in order to accommodate varying lengths of cigarette packs. One side wall of the insert is biased toward the other side wall of the insert to snugly accommodate varying widths of cigarette packages. A pocket is provided on the side of the package for holding a cigarette lighter which may either be purchased separately or which may be manufactured integrally with the cigarette case and which may be fueled as desired.

These and other objects and advantages of the invention will become readily apparent as the following description is read in conjunction with the accompanying drawings wherein like reference numerals are used to refer to the views.

DESCRIPTION OF THE PREFERRED EMBODIMENT

Figure 1:
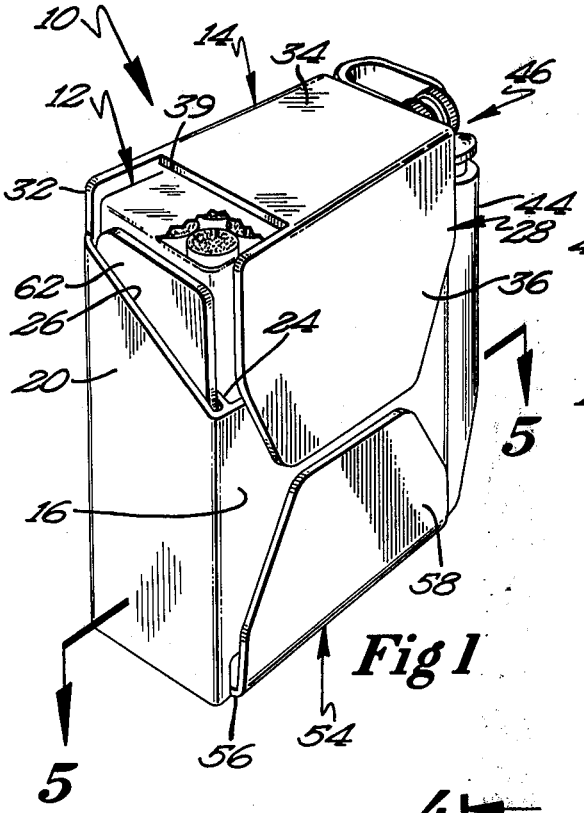
FIG. 1 is a front perspective view of the instant invention.
Figure 2:
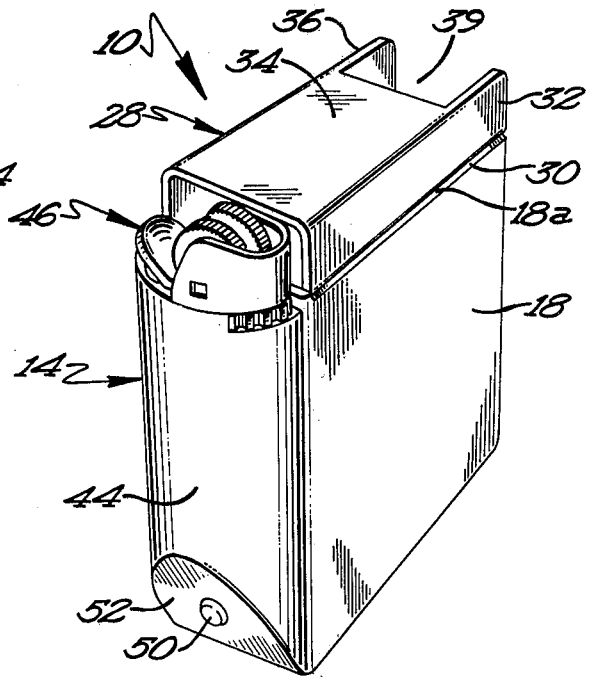
FIG. 2 is a rear perspective of the invention.
Figure 4:
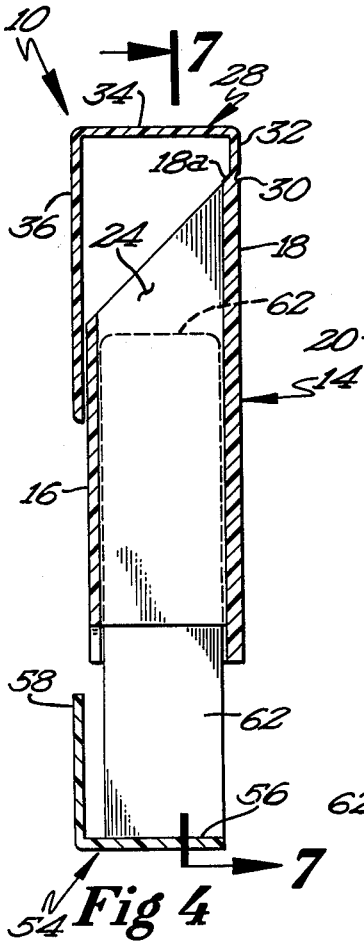
FIG. 4 is a sectional view taken along line 4—4 of FIG. 3.
Figure 3:
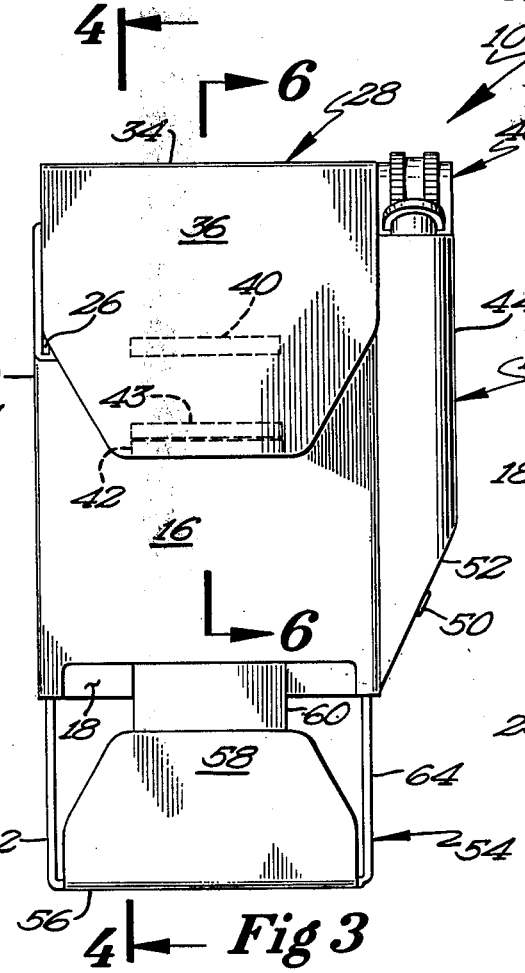
FIG. 3 is a front plan view of the invention.

An adjustable container, generally 10, is designed for holding a cigarette package 12. Container 10 is comprised of a generally rectangular sleeve 14 having a front 16, a back 18, and first and second sides 20 and 22 respectively. A sleeve wall 24 is located parallel to and spaced inwardly from first side 20 thereby leaving a slide pocket 26 therebetween. Sleeve 14 is preferably molded of a plastic material and in particular of material which is capable of being molded and having hinges formed therefrom. Located at the top edge **18*a* of back 18 is lid 28 which is hinged to back 18 by means of a live plastic hinge 30. Lid 28 is comprised of a rear wall 32, a top 34 and a front 36. Top 34 has a cutout 39 therein allowing soft packs of cigarettes to be accessed when lid 28 is closed. As can be seen in FIG. 2, lid back 32 is co-planar with sleeve back 18 when lid 28** is closed.

Figure 6:
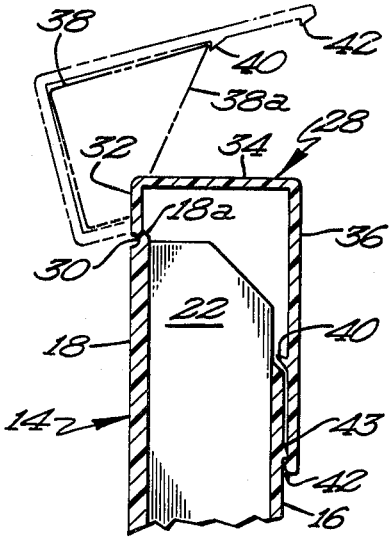
FIG. 6 is a sectional view taken along line 6—6 of FIG. 3.

As can be seen particularly in FIG. 6, the configuration of lid 28 is such that the opening of lid 28 also tends to open the lid 38 of cigarette pack 12 when cigarette pack 12 is of the hard-pack variety. Lid 40 on the under side of lid front wall 36 engages the bottom front edge **38*a* of cigarette pack lid 38 so as to cause lid 38 to open upon opening of lid 28. Rib 42 at the bottom edge of front wall 36 engages a similarly located catch 43 on front wall 16 to secure lid 28 to sleeve 14**. Of course, any well known closure fastener may be utilized.

A curved lighter wall 44 is molded integrally with sleeve 14 for holding a lighter 46 therein. Lighter 46 may be of the disposable type which may be slipped in and out of pocket 48 formed by wall 44 or which may be permanently built into pocket 48. A refilling aperture 50 may be provided in the bottom wall 52 of lighter pocket 48. Of course, if lighter 46 is built in, provision may be made for maintaining lighter 46 such as being able to replace the flint and the like. If desired, lighter 46 may be a built-in disposable lighter.

Figure 8:
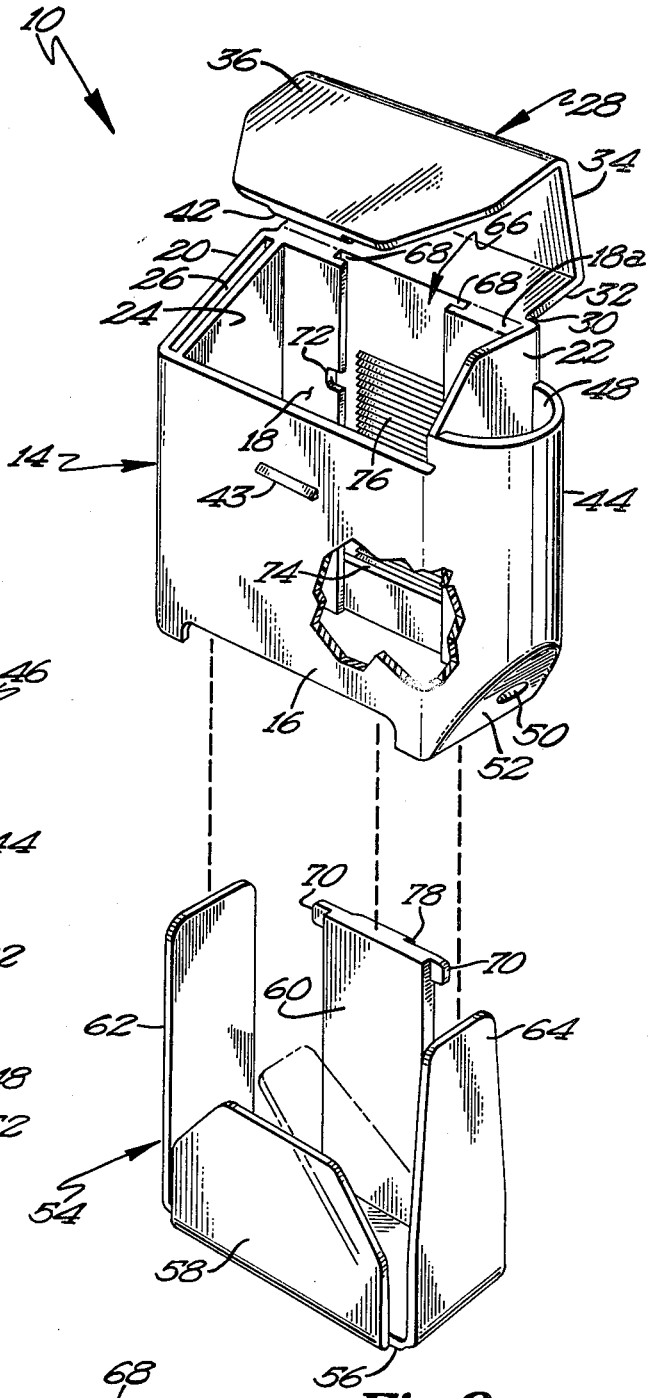
FIG. 8 is an exploded view of the instant invention.

An insert 54 is slidably located in sleeve 14 and can be moved vertically up and down relative to sleeve 14 to provide for varying lengths of cigarette packages. Insert 54 is comprised of a generally rectangular bottom wall 56 having a front wall 58 and an insert back panel 60 attached thereto. A first insert side wall 62 is attached to insert bottom wall 56 and a second insert side wall 64 is hingedly attached to insert bottom wall 56 and is molded in such a manner as to be biased toward first insert side wall 62 as shown in FIG. 8. Particularly, second side wall 64 will tend to assume the position shown in phantom in FIG. 8 thereby pressing the cigarette package against first side wall 62 and maintaining a snug fit therewith.

Figure 5:
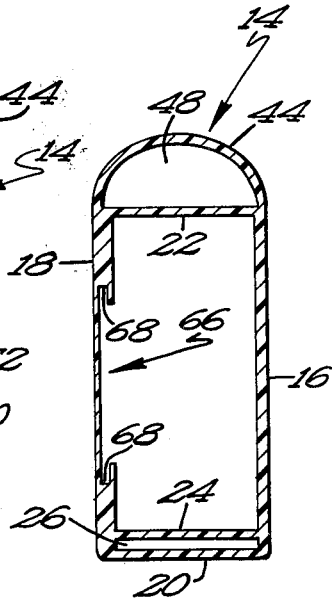
FIG. 5 is a sectional view taken along line 5—5 of FIG. 1.
Figure 7:
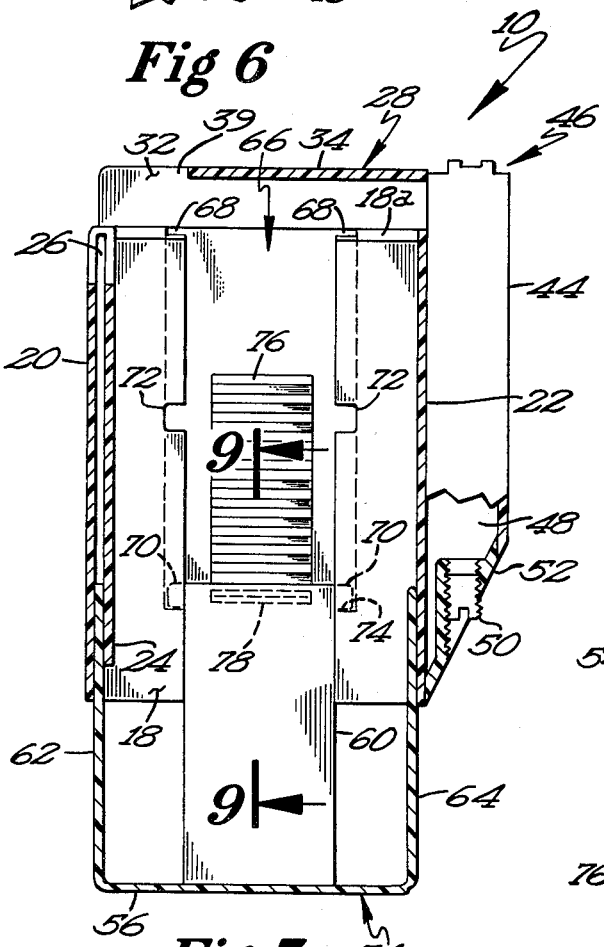
FIG. 7 is a sectional view taken along line 7—7 of FIG. 4.
Figure 9:
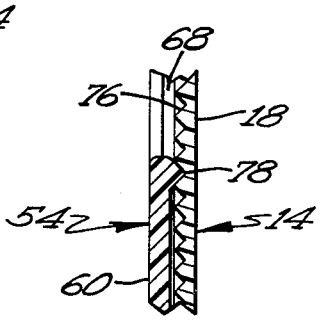
FIG. 9 is a sectional view taken along line 9—9 of FIG. 7.

Located in the rear wall 18 of sleeve 14 is slot 66 which is T-shaped in cross section as shown particularly in FIGS. 5, 7 and 8. Slot 66 has recessed portions 68 into which fit tabs 70 located on the sides of insert back panel 60. Tabs 70 are inserted through cutouts 72 as shown in FIG. 7. Slot 66 has a bottom stop 74 to provide an ultimate limit for the length of the cigarette package. As shown in detail in FIG. 9, ridged surface 76 engages with nip 78 on the rear of back panel 60 to provide a frictional engagement mechanism to hold insert 54 in place relative to sleeve 14 unless the owner decides to change the length of the package.

As can be seen particularly in FIG. 7, insert first side wall 62 slides in pocket 26 which is formed as mentioned heretofore between first side wall 20 and sleeve wall 24.

While the preferred embodiments of the present invention have been described, it should be understood that various changes, adaptations and modifications may be made therein without departing from the spirit of the invention and the scope of the appended claims.

What is claimed is:

1. An adjustable container for cigarette packages, said container comprising:

a rectangular sleeve having a front, a back, and first and second sides;

a lid hingedly attached to said sleeve back;

a rectangular insert slidably located in said sleeve to accommodate cigarette packages of different lengths, said insert having means for snugly accommodating cigarette packages of differing widths.

2. The adjustable container for cigarette packages of claim 1 wherein said insert comprises:

an insert bottom wall; and a first insert side wall attached to said insert bottom wall, said accommodating means further comprising a second insert side wall, said second insert side wall being hingedly attached to said insert bottom wall and biased toward said first insert side wall.

3. The adjustable container for cigarette packages of claim 2 wherein said insert further comprises an insert front wall hingedly attached to said insert bottom wall.

4. The adjustable container for cigarette packages of claim 3 wherein said sleeve back further comprises a vertically disposed track therein.

5. The adjustable container for cigarette packages of claim 4 wherein said insert further comprises an insert back panel, said insert back panel being slidably located in said track.

6. The adjustable container for cigarette packages of claim 5 wherein said track and said insert back panel have detent means thereon to provide a locking relationship therebetween.

7. The adjustable container for cigarette packages of claim 5 wherein said lid does not extend the full width of said sleeve back so as to provide an opening for accessing soft pack.

8. The adjustable container for cigarette packages of claim 5 wherein said sleeve lid further comprises means for engaging the lid of a hard pack so that when said sleeve lid is opened, said hard pack lid will open.

9. The adjustable container for cigarette packages of claim 8 wherein said sleeve lid comprises:

a lid back panel co-planar with said sleeve back when said sleeve lid is closed;

a lid top panel attached to said sleeve back; and a lid front panel attached to said lid top panel and said engaging means being located on said lid front panel.

10. The adjustable container for cigarette packages of claim 5 further comprising means attached to one of said sides for holding a lighter.

11. The adjustable container for cigarette packages of claim 5 further comprising a lighter attached to one of said sides.

12. The adjustable container for cigarette packages of claim 2 wherein said sleeve further comprises a sleeve wall parallel to and spaced inwardly from said sleeve first side, said first insert side wall being slidably located between said sleeve wall and said sleeve first side.

* * * * *